United States Patent [19]

Dent

[11] Patent Number: 5,062,245

[45] Date of Patent: Nov. 5, 1991

[54] TELESCOPIC BEAM

[76] Inventor: Nigel A. Dent, Standingford House, Cave St., Oxford, OX4 1BA, England

[21] Appl. No.: 458,614

[22] PCT Filed: May 19, 1989

[86] PCT No.: PCT/GB89/00553

§ 371 Date: Feb. 23, 1990

§ 102(e) Date: Feb. 23, 1990

[87] PCT Pub. No.: WO89/11575

PCT Pub. Date: Nov. 30, 1989

[30] Foreign Application Priority Data

May 21, 1988 [GB] United Kingdom ..... 8812063

[51] Int. Cl.[5] ..... E04H 12/34

[52] U.S. Cl. ..... 52/118; 52/632; 52/732; 182/2

[58] Field of Search ..... 182/2; 248/188.5; 52/118, 632, 731, 732, 117

[56] References Cited

U.S. PATENT DOCUMENTS

| | | | |
|---|---|---|---|
| 701,042 | 5/1902 | Holmes | 248/188.5 |
| 2,165,426 | 7/1939 | Tuttle et al. | 248/188.5 |
| 3,292,956 | 12/1966 | Schiansky | 248/188.5 X |

FOREIGN PATENT DOCUMENTS

| | | |
|---|---|---|
| 1205256 | 11/1965 | Fed. Rep. of Germany . |
| 2642235 | 3/1978 | Fed. Rep. of Germany . |
| 1181564 | 7/1959 | France . |
| 413711 | 7/1934 | United Kingdom . |

*Primary Examiner*—Richard E. Chilcot, Jr.
*Assistant Examiner*—Linda J. Watson
*Attorney, Agent, or Firm*—Davis, Bujold & Streck

[57] ABSTRACT

A telescopic beam has a cross-section comprising an array of members (11–17) whose cross-section are of essentially spiral or modified spiral form such that members have lengths of identical (or broadly identical) cross-section (in profile and dimension) and constant (or broadly constant) cross-section along their axis. In the array the members are rotationally offset relative to one another about an axis (A) of the beam parallel to their own axis. In addition the members in the array engage one another such that relative linear movement between two adjacent members is constrained to be possible only in the direction of their axis. The array is assembled to produce the telescopic beam. The maximum number of members in any beam is dependent on the magnitude of the rotational offset incorporated in the particular section used. Any amount of rotational offset can be selected and so can any number of sections from a minimum of two to a maximum restricted only by the practical limits of the production process and the material chosen.

7 Claims, 2 Drawing Sheets

TELESCOPIC BEAM

Figure 1:
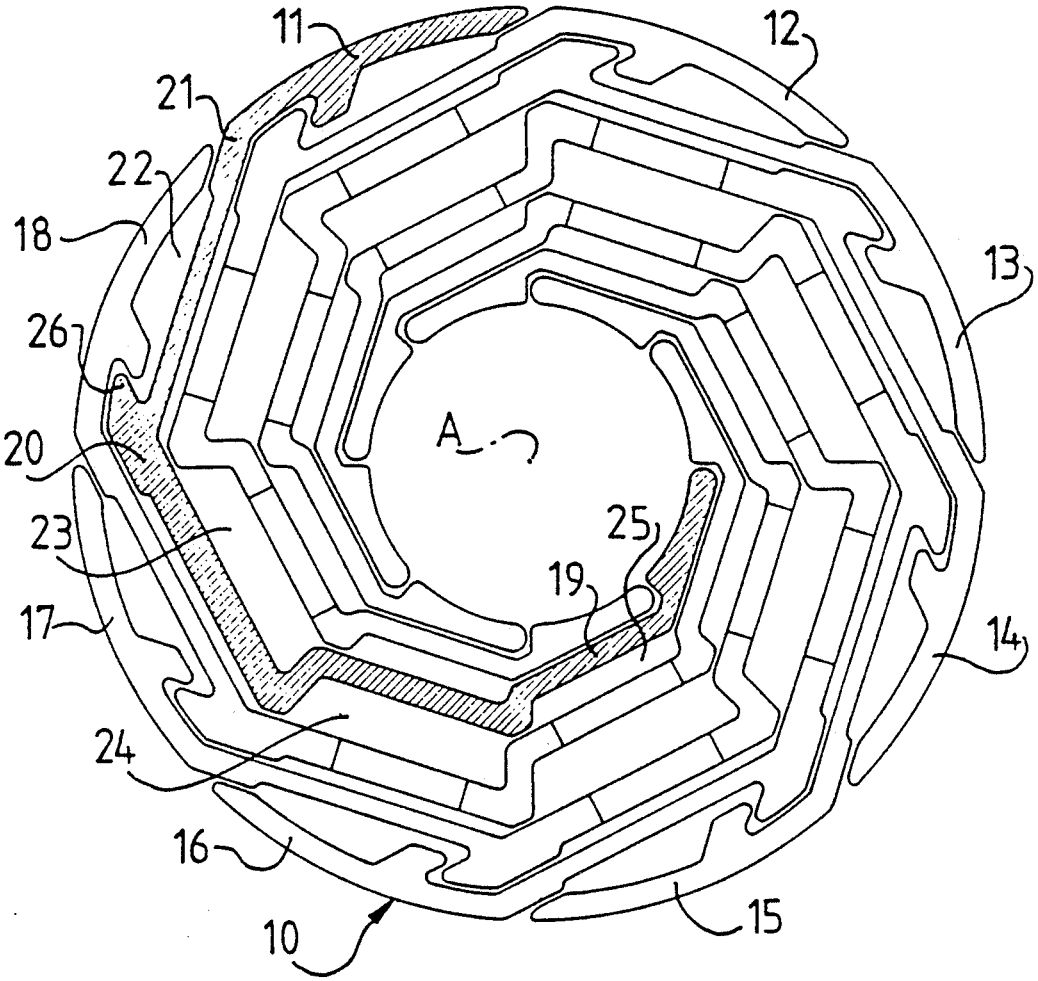

This invention relates to a telescopic beam.

Known forms of telescopic beams find applications in numerous fields ranging far beyond the eponymous optical magnifier. They may for example be used as radio aerials, parts of collapsible furniture, components of cranes, and in hydraulic or pneumatic devices. In general telescopic beams can be used whenever it is desired to constrain movement to a linear (although not necessarily straight) path. A similar function is served by slides used for example in furniture drawers, particularly filing cabinet drawers.

Known telescopic beams are composed of a series of members stowed within one another and as such will hereafter be referred to as being of reducing section. A common disadvantage of a reducing section beam is that successive members in the series are accommodated broadly within the periphery of the immediately preceding section, and therefore for members of similar wall thickness and type of material the bending stiffness of the sections is the lower according to their position in the series. A further disadvantage with some designs is the relatively great variation in bending stiffness according to the direction of bending, for example drawer slides are stiff in the vertical direction, but are commonly flexible in the direction horizontally sideways to their direction of travel. Yet a further major disadvantage of existing telescopic beams and slides is the fact that, due to the need for special tooling for each component of different cross-section, the production of a new telescope or slide is an expensive undertaking.

Broadly the present invention provides a telescopic beam having a cross-section of essentially spiral or modified spiral form such that a beam is made up of a nested array of members of substantially identical cross-section (in profile and dimension) and substantially constant cross-section along their axis; the members being rotationally offset to one another about an axis of the beam parallel to their own axis and engaging one another such that relative movement between two adjacent beams is constrained to be in the direction of their axis. Thus a series of members can be assembled to produce a telescopic device, the maximum number of members in any device being defined by the magnitude of the rotational offset incorporated in the particular section used. It will be apparent that the invention however allows considerable versatility in the choice of any value of rotational offset allowing for any number of sections from a minimum of two to a maximum restricted only by the practical limits of the production process and material chosen.

In a basic form the invention consists of a beam cross-section in the shape of an arc of an Archimedean spiral, that is a spiral whose change in distance from the center is constant with change in angular location. Typically a second identical section will fit inside or outside the first, provided it is first rotated about the center of the spiral by an amount which depends on the thickness, and geometry, of the material being used. In practice the pure form of the spiral will have to be modified for example to allow for different material thickness in different parts of the spiral, to produce flat sections in the spiral, to provide running clearance between sections, to accommodate production tolerances, to provide working voids between sections for example to accommodate travel stops, springs bushes and the like, or to provide a means to prevent relative rotational movement of adjacent sections in the plane of the cross-section.

In a variation of the invention, a telescopic device may be assembled from members whose cross-sections are not identical, but whose form follows the principles already established in the invention. Similarly, member cross-sections may differ due to features on their radially internal or external faces. Alternatively, the cross-section of the members may be varied along the length of the beams.

The angular extent of the spiral around a central axis of the beam will normally be approximately 360 degrees, to obtain a roughly constant bending stiffness in any direction. However a particular function, such as providing access to the interior of the beam, may be achieved by omitting a beam.

According to a first aspect of the present invention there is provided an extendible beam characterized by being made up of an array of overlapping arc-like members disposed substantially symmetrically about a longitudinal axis of the beam, the majority of the members having substantially similar cross-sections in a direction transverse the axis; each member of the array providing for angular axial alignment of the member relative to at least one other member in the array; and for slidable engagement of the member with another so that relative linear movement between two adjacent members of the sequence occurring during extension of the beam is constrained so as to be substantially or entirely in the direction of the axis.

According to a first preferred version of the present invention there is provided an extendible beam characterized in that each member has a cross-section in a direction transverse the axis in the approximate form of a spiral and comprising an inner section, an intermediate section and an outer section, the disposal of the members in the array being such that for each member the inner section is located closer to the axis than the remaining sections; the intermediate section includes the, or an, alignment part and the outer section serves as, or locates, part of an outer surface of the beam.

According to a second preferred version of the present invention or the first preferred version, thereof there is provided an extendible beam characterized in that the cross section of at least one of the members is not constant along the length of the member in the direction of the axis.

According to a third preferred version of the present invention or the first and second preferred versions thereof there is provided an extendible beam characterized in that the cross section of at least one member in the array has a profile which, with the member located in the array, provides for a working void in the array between the member and an adjacent member in the array.

According to a fourth preferred version of the present invention or of the first, second or third preferred versions thereof there is provided an extendible beam characterized by the provision of a load mounting point on an outer section.

According to a fifth preferred version of the present invention or of any of the preceding preferred versions thereof there is provided an extendible beam characterized by the provision of at least one ram for extending the beam by sequential displacement of members in the array.

According to a sixth preferred version of the present invention or of any of the preceding preferred versions thereof there is provided an extendible beam characterized by being of composite form comprising at least two extendible beams joined end to end either directly or indirectly by way of an intermediate component.

According to yet another version of the present invention there is provided a measuring device characterized in that it comprises an extendible beam according to the present invention or any of the preferred versions thereof having a calibrated scale on a portion of at least two members of the array at least with the beam partially or wholly extended.

Figure 2:
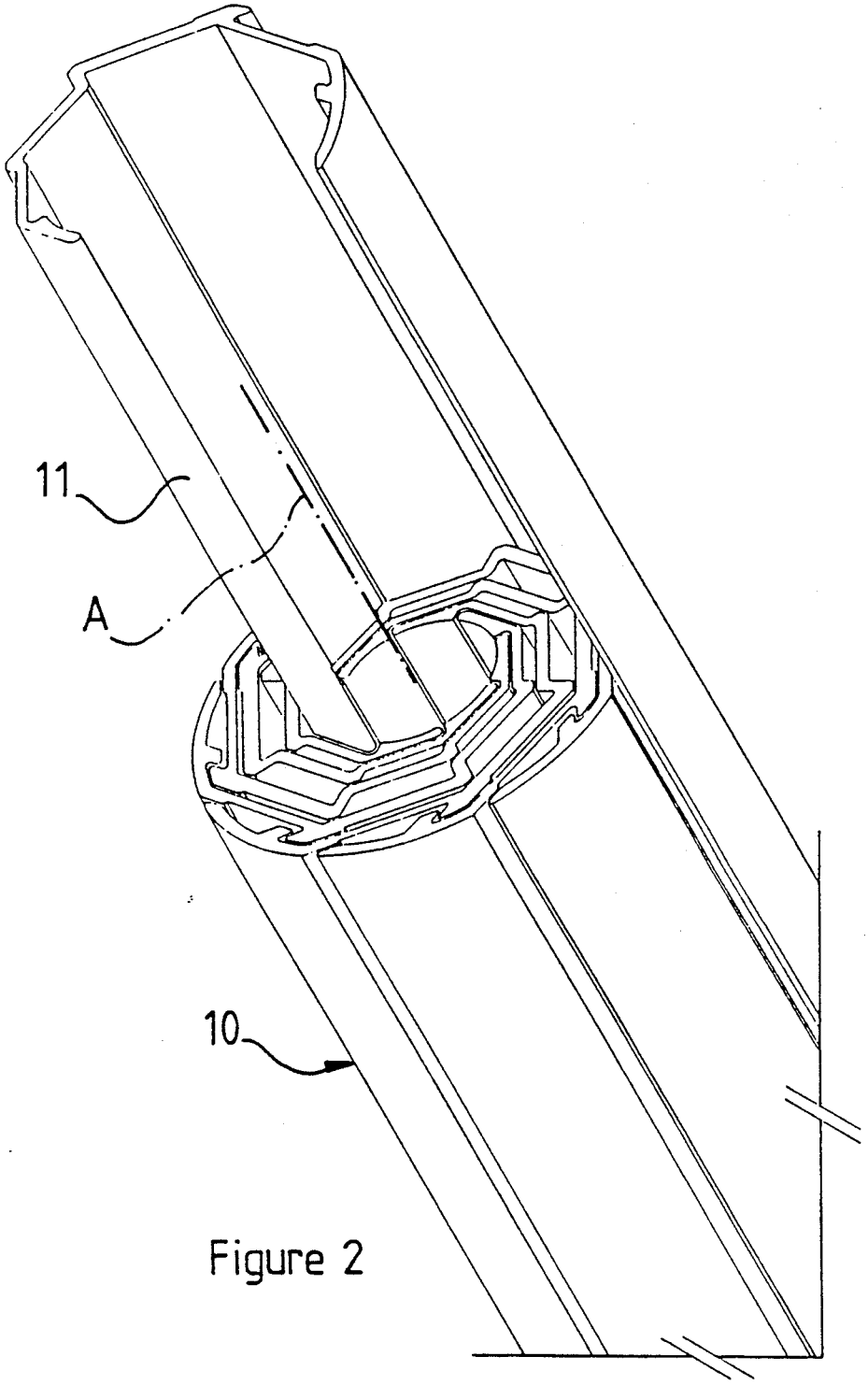

By way of illustration, an exemplary embodiment of the invention will now be described with reference to the accompanying drawings of an extendible beam made up of eight members of which:

FIG. 1 shows a cross-sectional view wherein one of the eight (identical) members is cross-hatched for clarity; and FIG. 2 is a perspective view of a partially extended beam having a cross-section similar to that of FIG. 1, and.

Referring to FIG. 1 the telescopic beam 10 has a longitudinal axis A about which are disposed an array of eight members 11–18. The members 11–18 are identical in form and function and to help in describing the FIGURE member 11 is shown cross-hatched.

The members 11–18 are each a modified spiral. Member 11 is in three sections: inner section 19, intermediate section 20 and outer section 21. The profile of each member 11–18 is created in dependence upon the function of that section. In this working voids 22, 23, 24, and 25 are provided to accommodate springs (not shown) which control the travel of members relative to one another. An outwardly-facing rib 26 engages with an inwardly-facing rib 27 on an adjacent member 18 to prevent relative rotational movement between the two sections. Outer surface 28 is of cylindrical form to provide a smooth and pleasing external appearance to the telescope when in a fully closed condition.

Although the beam in this embodiment contains eight members 11 to 18 spaced symmetrically around axis A it is possible to omit one member so leaving a space providing access to the inside of the beam (for example to provide for the punching of holes to accommodate the springs).

FIG. 2 shows beam 10 with member 11 extended by means of a spring housed within the beam as referred to earlier in connection with FIG. 1.

The embodiment is applicable to a wide range of applications for which reducing section beams have previously been used such as aerials, tripods, carriers and so forth. However the benefits available from the present invention include improved beam stiffness, the ability to locate load carrying points on the outer part of any member and so at any point along the length of the beam when extended. In addition the production of the beam of the present invention involves the production of members of a common cross-section rather than, as is the case with beams of reducing section, a set of members.

I claim:

1. An extendible beam characterized by being made up of an array of nested overlapping substantially identical members disposed substantially symmetrically about a longitudinal axis of the beam, the members having substantially arcuate cross-sections in a direction transverse the axis; each member of the array providing for angular axial alignment of that member relative to at least one other member in the array and for slidable engagement of that member with that other member so that relative linear movement between two adjacent members occurring during extension of the beam is constrained so as to be substantially or entirely in the direction of the axis.

2. An extendible beam as claimed in claim 1 characterized in that each member has a cross-section in a direction transverse the axis in the form of a spiral.

3. An extendible beam as claimed in claim 1 characterized in that each member comprises an inner section, an intermediate section and an outer section, the disposal of the members in the array being such that for each member the inner section is located closer to the longitudinal axis than the remaining sections; the intermediate section provides at least in part for alignment of that member with the rest of the array and the outer section forms part of an outer surface of the beam.

4. An extendible beam as claimed in claim 1 characterized in that the cross section of at least one member in the array has a profile which, with an adjacent member located in the array, provides for a working void in the array between that member and the adjacent member in the array.

5. An extendable beam as claimed in claim 1 characterized in that an inner portion of each member of the array defines an interior surface of the extendable beam.

6. An extendible beam characterized by being made up of an array of nested overlapping substantially identical members disposed substantially symmetrically about a longitudinal axis of the beam, the members having substantially arcuate cross-sections in a direction transverse the axis; each member of the array spiraling about the longitudinal axis of the beam and providing for angular axial alignment of that member relative to at least one other member in the array and for slidable engagement of that member with that other member so that relative linear movement between two adjacent members occurring during extension of the beam is constrained so as to be substantially in the direction of the longitudinal axis.

7. An extendable beam as claimed in claim 6 characterized in that an inner portion of each member of the array defines an interior surface of the extendable beam.

* * * * *